United States Patent [19]

Adamson

[11] 4,154,274

[45] May 15, 1979

[54] GOLF CLUB CARRIER

[76] Inventor: David V. Adamson, 5432 Windsor Ave., Chicago, Ill. 60630

[21] Appl. No.: 915,979

[22] Filed: Jun. 16, 1978

[51] Int. Cl.[2] ..... A63B 55/02

[52] U.S. Cl. ..... 150/1.5 R; 224/45 R

[58] Field of Search ..... 150/1.5 R, 1.5 B, 1.5 C; 224/45 P, 45 R; 211/60 G, 14

[56] References Cited

U.S. PATENT DOCUMENTS

| | | | |
|---|---|---|---|
| 1,951,492 | 3/1934 | Schneider | 150/1.5 R |
| 2,091,298 | 8/1937 | Agnew | 150/1.5 R |
| 2,791,255 | 5/1957 | Ogden | 150/1.5 R |
| 3,164,185 | 1/1965 | Ingoldt | 150/1.5 R |
| 3,172,681 | 3/1965 | Moses | 150/1.5 R X |
| 3,883,150 | 5/1975 | Varela | 150/1.5 R X |
| 3,966,051 | 6/1976 | Hollister | 211/60 G X |

*Primary Examiner*—Donald F. Norton
*Attorney, Agent, or Firm*—Joel E. Siegel

[57] ABSTRACT

A golf club carrier having a plurality of relatively short club receiving tubes positioned between front and rear vertical plates. A handle assembly is located adjacent the upper ends of the front and rear plates to the front of the longitudinal center of gravity of the clubs and carrier.

11 Claims, 3 Drawing Figures

GOLF CLUB CARRIER

BACKGROUND OF THE INVENTION

This invention relates to a hand carried golf club carrier and more particularly to a carrier which is light in weight and convenient in use, while still offering protection to the golf clubs from the injurious effect of rubbing and knocking contact with each other and with the carrier.

The game of golf requires the transportation of a plurality of golf clubs and other accessories over great distances. With the development of the game, golf bags were developed to carry the clubs and accessories, and these bags became larger and heavier with the passage of time. Boys were frequently hired to carry the bags, and if boys were either unavailable or unaffordable this task of transportation of the bags became the responsibility of the golfer. This led to the introduction and use of the golf cart. However, golf carts cannot always go where the boys had gone. Again, the golfer must carry his own clubs. One of the problems in having the golfer carry his own clubs is that when he wants to play the ball, he must lay the golf bag down. This has the effect of getting the clubs dirty and causing resulting damage thereto as well as making it difficult to extract and replace clubs from the bag. Accordingly, it has recently become quite popular for golfers to abandon the larger and heavier golf bags and switch to light weight golf club carriers.

The present invention is directed to such a light weight carrier which offers the protection and features of the heretofore used heavier and larger carriers.

SUMMARY OF THE INVENTION

It is a primary object of the present invention to provide a hand carried golf club carrier which is light in weight and easy to transport.

Another object of the invention is to provide such a carrier which protects the golf clubs while being transported and while resting on the ground.

A further object of the invention is to provide such a carrier which facilitates the withdrawal and replacement of clubs therefrom.

A still further object of the invention is to provide such a carrier which includes means to transport miscellaneous golf accessories.

These and other objects are realized in accordance with the present invention by providing a golf club carrier having a plurality of relatively short club receiving tubes positioned between front and rear vertical plates. A handle assembly is located adjacent the upper ends of the front and rear plates to the front of the longitudinal center of gravity of the clubs and carrier. When the carrier is raised from a position of rest, the movement induced about the point of lift, raises or tends to raise the front of the carrier above the horizontal. This holds the carrier in balance and restrains the clubs from slipping from the carrier. The tubes are flared at both ends and are of different lengths to protect the clubs, to increase carrier club capacity, and to facilitate club selection. The lowermost tubes are positioned a sufficient distance above the lower edges of the front and rear plates to prevent damage to the club heads when the carrier is rested on the ground. The use of multiple length tubes and the vertical spacing between rows of tubes prevents collision damage between adjacent clubs. Upper and lower trays are provided to store golf balls, tees and other golf accessories.

BRIEF DESCRIPTION OF THE DRAWING

In the accompanying drawings, forming a part of this specification, and in which like numerals are employed to designate like parts throughout the same.

DESCRIPTION OF A PREFERRED EMBODIMENT

Figure 3:
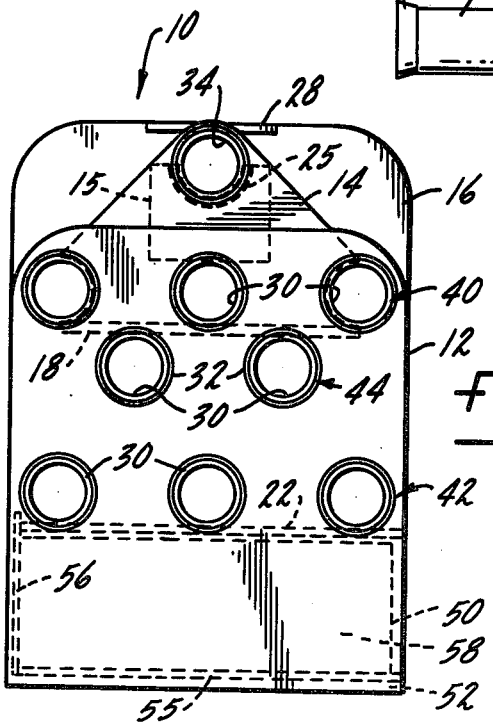
FIG. 3 is a front elevational view of the carrier shown in FIG. 2.

Referring to the drawings, a golf club carrier constructed in accordance with the present invention is indicated generally at 10. Carrier 10 includes a front vertical plate 12, an intermediate vertical plate 14, and a rear vertical plate 16. Plates 12 and 14 are connected together by an upper horizontal spacer plate 18 and plates 12 and 16 are connected together by a lower horizontal spacer plate 22. A plurality of horizontally aligned openings 20 are formed in plates 12, 14 and 16. Openings 20 are preferrably arranged in groups of two or three openings having a common horizontal plane, as best seen in FIG. 3. Plates 12, 14, 16, 18, and 22 are preferrably constructed from a light weight material such as three-sixteenths inch impact resistant plastic.

Figure 1:
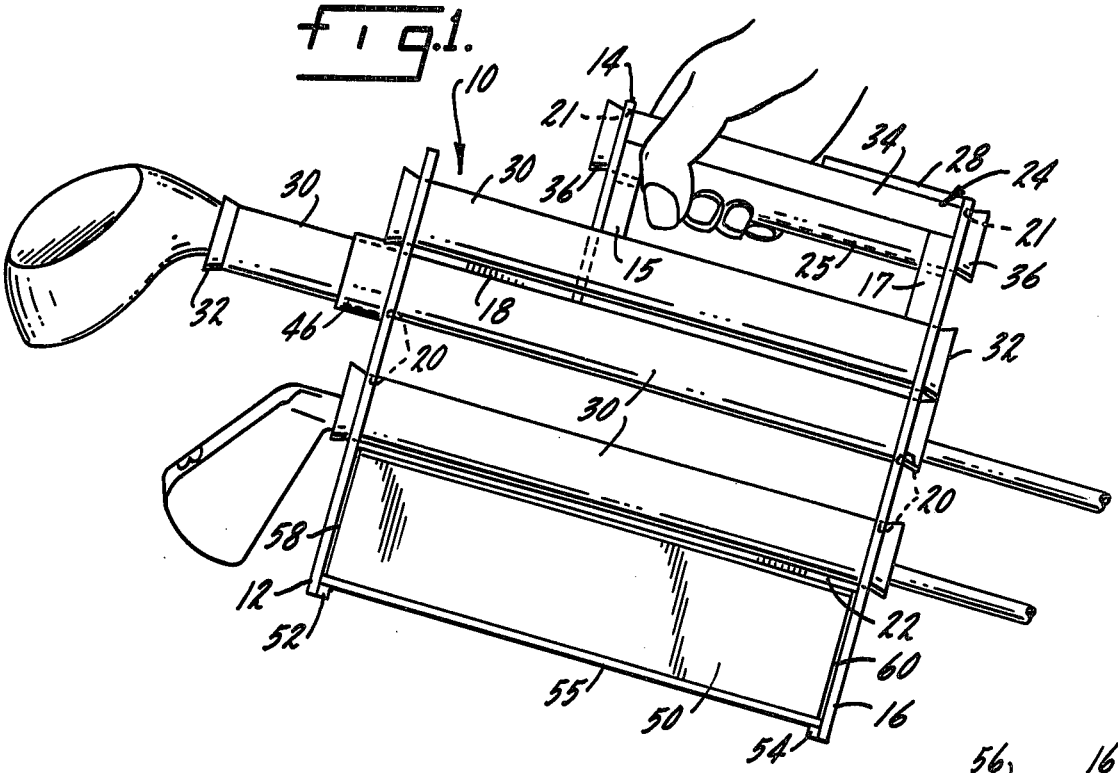
FIG. 1 is a side elevational view of the carrier showing the carrier in its inclined carrying position.

A hand grip assembly 24 extends between the upper portions of plates 14 and 16. Hand grip assembly 24 includes a semi tubular hand grip 25 secured at one end to plate 14 and at the other end to plate 16. Hand grip 25 is secured to plates 14 and 16 using support blocks 15 and 17 respectively secured to the ends of grip 25 and plates 14 and 16. As best seen in FIGS. 1 and 3, hand grip 25 is positioned around the lower half of horizontally aligned openings 21 in plates 14 and 16. Openings 21 are positioned above the upper edges of plate 12. As seen in FIG. 3, plte 14 is a substantially triangular shaped member having an opening 21 at its apex and a row of openings 20 in horizontal alignment with the upper row of openings in plate 12.

A plurality of golf club receiving tubes 30 extend between and through corresponding aligned openings 20 in plates 12, 14, and 16. As best seen in FIG. 1, the ends of tubes 30 are flared outwardly at 32. This outward flaring retains the tubes 30 in place at the outward surfaces of plates 12 and 16 and protects the golf club grips during insertion and withdrawal. A golf club receiving tube 34 extends through grip 25 and openings 21 in plates 14 and 16. The outer ends of tube 34 are flared at 36.

A horizontal score plate 28 is secured to vertical plate 16 immediately above tube 34. Score plate 28 is effective to prevent the lifting of carrier 10 from the rear portion of hand grip 25. Accordingly, lift assembly 24 is operational only from a point forward of the longitudinal center of gravity of the carrier 10 and the golf clubs positioned therein. Thus, when the carrier 10 and the clubs are raised from their rest position, the movement induced about the point of lift raises, or tends to raise, the front of the carrier above the horizontal, thereby holding the carrier in balance and restraining the clubs from slipping from the carrier.

Figure 2:
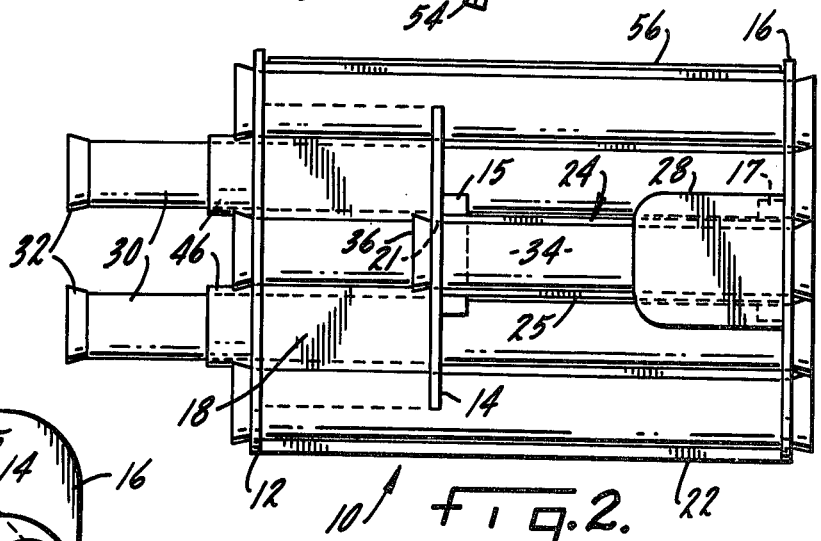
FIG. 2 is a top plan view of the carrier.

The preferred embodiment as shown in FIGS. 1–3 discloses a carrier 10 of nine club capacity. Carrier 10 includes an upper row 40 of three transversely spaced tubes 30 extending through plates 12, 14 and 16; an intermediate row 44 of two transversely spaced tubes 30 extending through plates 12 and 16; and a lower row 42 of three transversely spaced tubes 30 extending through plates 12 and 16. The tubes 30 in row 44 extend outward beyond plate 12 approximately three inches and are positioned approximately one and one half inches on centers below the tubes 30 in row 40. A retaining ring 46 is preferably provided to retain the tubes 30 in row 44 in place. The tubes 30 in row 44 are positioned vertically below the center of the spacing between the tubes 30 in row 40. The tubes 30 in rows 40 and 42 are separated transversely by approximately three inches on centers. The above recited spacing of the tubes 30 provides protection of the club heads and permits ready club selection, withdrawal and return.

Referring to FIG. 3, upper spacer plate 18 abuts against the bottom of tubes 30 in row 40. The space formed between the tubes 30 in row 40 provides storage for tees, markers, pencils, etc. The spacing between the tubes 30 in rows 40 and 42 as recited above, permits the storage of golf balls between adjacent tubes 30.

In order to prevent the club heads from contacting the ground when the carrier 10 is resting on the ground, the present invention contemplates spacing the center of the lowermost tubes 30 a minimum of 3½ inches above the lower edges of plates 12 and 14. A lower tray 50 is slidably received on horizontal plate 55. Plate 55 is supported on members 52 and 54 which in turn are respectively secured to the inside surfaces of the lower ends of plates 12 and 16. The front 56 of tray 50 extends upward beyond the sides 58 and 60 of tray 50 for contact with lower spacer plate 22, as best seen in FIG. 3.

The invention forming the subject of this application is capable of a wide variety of mechanical expressions and therefore it is to be understood that the invention herewith shown and described is to be taken merely as a preferred embodiment and that such minor changes in arrangement and construction of parts may be made as will remain within the spirit of the invention, and the scope of what is claimed.

What is claimed is:

1. A compact, hand carried, golf club carrier; comprising: a front vertical plate, an intermediate vertical plate, and a rear vertical plate; said front plate, said intermediate plate and said rear plate being positioned parallel to one another; a plurality of horizontally aligned openings formed through said front plate and said rear plate; a plurality of golf club receiving tube means extending between and through corresponding horizontally aligned openings in said front plate and said rear plate; handle means extending between the upper portions of said intermediate plate and said rear plate; said handle means including a golf club receiving tube means extending between and through horizontally aligned openings in said intermediate plate and said rear plate; and a means positioned adjacent said rear plate for defining a point of lift when the carrier is raised from its position of rest so as to induce a movement of said carrier about said point of lift which tends to raise the front plate and thereby restrain the clubs within the carrier.

2. The invention as defined in claim 1 wherein the outer ends of said tube means are flared outwardly so as to facilitate the insertion and withdrawal of a golf club.

3. The invention as defined in claim 1 wherein said handle means includes a semi-tubular grip member extending between said intermediate and rear plates for receipt of said golf club receiving tube therein.

4. The invention as defined in claim 1 wherein the center of the lowermost openings in said front and rear plates are spaced a minimum of 3½ inches from the lower edges of said front and rear plates so as to preclude the head of a golf club received therein from contacting the ground during such time as the carrier is resting on the ground.

5. The invention as defined in claim 1 wherein said openings through said front and rear plates are arranged in vertically spaced rows.

6. The invention as defined in claim 5 wherein said intermediate plate has openings therethrough in horizontal alignment with the openings in the upper row of openings through said front and rear plates.

7. The invention as defined in claim 6 wherein an upper horizontal spacer plate extends between said intermediate plate and said front plate immediately below the upper row of openings in said front plate.

8. The invention as defined in claim 6 wherein a lower horizontal spacer plate extends between said front plate and rear plate immediately below the openings in the lower row of openings through said front and rear plates.

9. The invention as defined in claim 8 wherein a lower tray means is positioned below said lower horizontal spacer plate.

10. The invention as defined in claim 5 wherein said tubes passing through an intermediate row of openings in said front and rear plates extend further outward beyond the front plate than the tubes passing through the upper and lower rows of openings in said front and rear plates.

11. The invention as defined in claim 5 wherein the spacing between the tubes in at least one row is equal to or greater than the diameter of a golf ball so as to permit the storage of golf balls between adjacent tubes.

* * * * *